US010080402B2

(12) United States Patent
Chen

(10) Patent No.: US 10,080,402 B2
(45) Date of Patent: Sep. 25, 2018

(54) SNAP FASTENER

(71) Applicant: Duraflex Hong Kong Limited, Hong Kong (HK)

(72) Inventor: Te Chien Chen, Hong Kong (HK)

(73) Assignee: Duraflex Hong Kong Limited, Hong Kong (HK)

( * ) Notice: Subject to any disclaimer, the term of this patent is extended or adjusted under 35 U.S.C. 154(b) by 0 days.

(21) Appl. No.: 15/539,141

(22) PCT Filed: Nov. 18, 2015

(86) PCT No.: PCT/CN2015/094928
§ 371 (c)(1),
(2) Date: Jun. 22, 2017

(87) PCT Pub. No.: WO2016/101734
PCT Pub. Date: Jun. 30, 2016

(65) Prior Publication Data

US 2017/0347756 A1 Dec. 7, 2017

(30) Foreign Application Priority Data

Dec. 25, 2014 (CN) ..... 2014 1 0822571

(51) Int. Cl.
*A44B 1/34* (2006.01)
*A44B 17/00* (2006.01)
*A44B 1/14* (2006.01)

(52) U.S. Cl.
CPC ..... *A44B 17/0005* (2013.01); *A44B 1/14* (2013.01); *A44B 17/0076* (2013.01);
(Continued)

(58) Field of Classification Search
CPC ..... Y10T 24/3611; Y10T 24/3613; Y10T 24/3497; Y10T 24/3672; Y10T 24/3683;
(Continued)

(56) References Cited

U.S. PATENT DOCUMENTS 691,709 A * 1/1902 Murphy ..... A44B 17/0082 24/692
4,570,307 A 2/1986 Kanzaka
(Continued)

FOREIGN PATENT DOCUMENTS

| | | | |
|---|---|---|---|
| CN | 1671312 | A | 9/2005 |
| CN | 102753051 | A | 10/2012 |
| CN | 204444478 | U | 7/2015 |

OTHER PUBLICATIONS

International Search Report of PCT Patent Application No. PCT/CN2015/094928 dated Feb. 25, 2016.

*Primary Examiner* — Robert Sandy
*Assistant Examiner* — Michael S Lee

(57) ABSTRACT

Disclosed is a snap fastener, comprising a face fastener (1) and a locating fastener (2) which are snapped with each other, wherein the face fastener (1) comprises a face shell (11) provided with an installation chamber (111), and a locating pin (12) made of plastic and integrally formed; and the locating pin (12) comprises a base (121), a rod body (122) and anti-rotation protrusions (125). In the implementation of the snap fastener of the present invention, the face fastener (1) can be separated into the face shell (11) and the locating pin (12), and the locating pin (12) is manufactured into a standard part for batch production and storage, thereby adapting face shells (11) with continuously updated designs, shortening delivery time, and reducing costs.

6 Claims, 7 Drawing Sheets

(52) U.S. Cl.
CPC ..... *A44B 17/0082* (2013.01); *A44B 1/34* (2013.01); *Y10T 24/3611* (2015.01)

(58) Field of Classification Search
CPC ..... Y10T 24/366; Y10T 24/3655; A44B 1/34; A44B 17/0082; A44B 17/0076; A44B 17/0005
See application file for complete search history.

(56) References Cited

U.S. PATENT DOCUMENTS

| | | | | | |
|---|---|---|---|---|---|
| 4,967,452 | A * | 11/1990 | Watanabe | ..... | A44B 1/08 24/113 MP |
| 5,940,940 | A * | 8/1999 | Tanikoshi | ..... | A44B 17/0082 24/108 |
| 6,618,909 | B1 * | 9/2003 | Yang | ..... | A44B 1/08 24/113 MP |
| 2006/0059664 | A1 * | 3/2006 | Sheng | ..... | A44B 1/14 24/90.1 |

* cited by examiner

SNAP FASTENER

FIELD OF THE INVENTION

The present application relates to a field of daily life, and more particularly relates to a snap fastener.

BACKGROUND OF THE INVENTION

A structure of the existing snap fastener comprises a pin and a box which are snapped with each other, wherein, a protruding rod vertically extending outwards and with concave edges is arranged on an end face of a base of the pin; a recess corresponding to the protruding rod is defined in an end face of the box; and protruding blocks are distributed around an opening of the recess. When used, the pin and the box are respectively mounted on sheet substrates to be connected and with through-holes; and in the presence of inherent elasticity of snap fastener materials, the protruding rod of the pin is pressed into the recess of the box, and protruding blocks are fixed in the concave edges, so that two sheet substrates to be connected can be connected together.

In the structure of the existing snap fastener, a face fastener configured for connecting with the pin and the box adopts an integrated structure mostly, and a structure and pattern of the face fastener has several versions usually according to the needs of design; the integrated structure demands that its face and leg should adopt the same material, which limits the selection of materials; even if a little change of the pattern or shape of the surface of the face fastener happens, the whole face fastener should be remade, so that the face fastener can't be manufactured into a standard part for batch production and storage; when different kinds of the snap fasteners are manufactured every time, the delay is caused because of a large workload.

Technical Problem

The technical problem of the present application is to provide a snap fastener wherein its face fastener can be separated into a face shell and a locating pin, manufacture the locating pin into a standard part for batch production and storage to be adapted to the face shell with constantly updated designs, shorten delivery time and reduce costs, aiming at the aforementioned defects in prior art.

Solutions of Solving Problems

Technical Solutions

The technical solutions of the present application for solving the technical problems are as follows: a snap fastener comprising a face fastener and a locating fastener which are snapped with each other is provided, wherein, the face fastener comprises: a face shell, wherein the face shell is provided with an installation chamber; and a locating pin, wherein the locating pin is made of plastic and integrally formed, and includes: a base, wherein the base is accommodated in the installation chamber, and anti-skidding structures are arranged on an end face exposed out of the installation chamber of the base; a rod body, wherein the rod body stands exactly on an end face of the base, and an end away from the base of the rod body is used to be connected to the locating fastener; and anti-rotation protrusions, wherein the anti-rotation protrusions are arranged at an outer edge of the end face in connection with the rod body of the base in a protruding manner, and the ends away from the base of the anti-rotation protrusions retract; and when the base is accommodated in the installation chamber, so that the locating pin and the face shell are assembled, the face shell completely covers the anti-rotation protrusions and is meshed therewith.

A fixing flange is formed at an edge of an opening around the installation chamber in an end face of the face shell, so that when the locating pin and the face shell are assembled, the face shell completely covers the anti-rotation protrusions and is meshed therewith.

A locating block is arranged around an edge of the fixing flange at the outer edge of the end face of the face shell in a protruding manner, and the locating block is slightly lower than the fixing flange and is spaced therewith.

When the locating pin and the face shell are assembled, the fixing flange is bent by way of riveting, heat-pressing or cold-pressing to completely cover the anti-rotation protrusions and be meshed therewith; and inner surfaces of the fixing flange are respectively arranged around the anti-rotation protrusions to form concavo-convex occlusion.

The face shell is a metal plate structure matching with a shape of the base; and an edge of the face shell is bent towards the rod body to form the fixing flange and the installation chamber; and when the locating pin and the face shell are assembled, the fixing flange is deformed by way of pressing to completely cover the anti-rotation protrusions and be meshed therewith.

Cross sections of the anti-rotation protrusions along a tangential direction of the base are triangular, and ridge portions of the anti-rotation protrusions extend along a radial direction of the base.

The rod body is located at the center of the end face of the base, and the anti-rotation protrusions are distributed on the outer edge of the end face of the base uniformly along a circumferential direction; and the anti-skidding structures are arranged between the anti-rotation protrusions and the rod body uniformly along a circumferential direction; and the anti-skidding structures and the rod body are exposed out of the face shell.

The face shell is formed out of the locating pin directly by way of injection molding to form the installation chamber configured for accommodating the base.

Reinforcing ribs are arranged on positions of the rod body connected with the base.

The present application further provides a snap fastener comprising a face fastener and a locating fastener which are snapped with each other, wherein, the face fastener comprises: a face shell, wherein the face shell is provided with an installation chamber; and limiting recesses, locating holes and the mounting through-hole passing through the face shell are defined in the bottom of the installation chamber; and a locating pin, wherein the locating pin is made of plastic and integrally formed, and includes: a base, wherein the base is accommodated in the installation chamber; a rod body, wherein the rod body stands exactly on an end face of the base; and anti-rotation protrusions, wherein the anti-rotation protrusions are arranged at an outer edge of the end face in connection with the rod body of the base in a protruding manner, and the ends away from the base of the anti-rotation protrusions retract; and anti-skidding structures, arranged on the end face exposed out of the installation chamber of the base, and located between the rod body and the anti-rotation protrusions; when the base is accommodated in the installation chamber, so that the locating pin and the face shell are assembled, an end away from the base of the rod body passes through the mounting through-hole and is connected to the locating fastener, and the anti-skidding structures are inserted in the locating holes correspondingly; and the anti-rotation protrusions are accommodated in the limiting recesses, and the face shell completely covers the anti-rotation protrusions.

Advantageous Effects of the Invention

Advantageous Effects

When implementing the snap fastener of the present application, the following advantageous effects can be achieved:

(1) The face fastener of the present application can be separated into the face shell and the locating pin, which are snapped with each other, so that the locating pin can be manufactured into a standard part for batch production and storage, thereby speeding up delivery and avoiding delay because of a large workload.

(2) As the face fastener of the present application can be separated into the face shell and the locating pin, the design of face shell can be variegated as required and be not limited by the material and the color of the locating pin.

(3) The locating pin of the present application is made of plastic material, has portability and lower costs; moreover, need not adopt an electroplating step required by metal material, which is more beneficial to the recycling of resources and environmental protection.

(4) The design of the anti-rotation protrusions can prevent the locating pin from rotating relative to the face shell effectively; moreover, the cross sections of the anti-rotation protrusions of the present application along a tangential direction of the base are designed to be an isosceles triangle, which can improve force balance of anti-rotation protrusions and enhance its strength to ensure it not easy to be broken.

(5) The ridge portions of the anti-rotation protrusions extend along a radial direction of the base, and top angles of the anti-rotation protrusions are an obtuse angle, so that two side portions of the anti-rotation protrusion can be connected to the end face of the base smoothly; and when processed and assembled, the reliable occlusion between the fixing flange and anti-rotation protrusions can be completed easily, the gap and the looseness are not formed easily, which can avoid the fixing flange from over-bending and being broken.

(6) The anti-skidding structures are a protruding part exposed out of the face shell, and the end of the protruding part has a reduction in diameter, which can reduce the contact area between the base and the substrate and increase pressure to make the anti-skidding structures be embedded into the substrate to avoid the snap fastener from sliding relative to the substrate effectively.

(7) The anti-rotation protrusions are arranged on the edge of the base along a circumferential direction, which can increase the thickness and strength of the base to avoid phenomena such as cracks and breaks, when the base and the face shell are assembled through a variety of processing methods.

(8) The step is formed because of a height difference between the fixing flange and the adjacent locating block; and a gap exists between the fixing flange and the locating block; and when the fixing flange made of plastic or metal is bent, this step structure having the gap can make the ductility of the fixing flange achieve the optimal effect, which is convenient for the fixing flange to completely cover the anti-rotation protrusions and be meshed therewith to enhance an anti-rotation effect.

BRIEF DESCRIPTION OF THE DRAWINGS

Description of the Drawings

Figure 1:
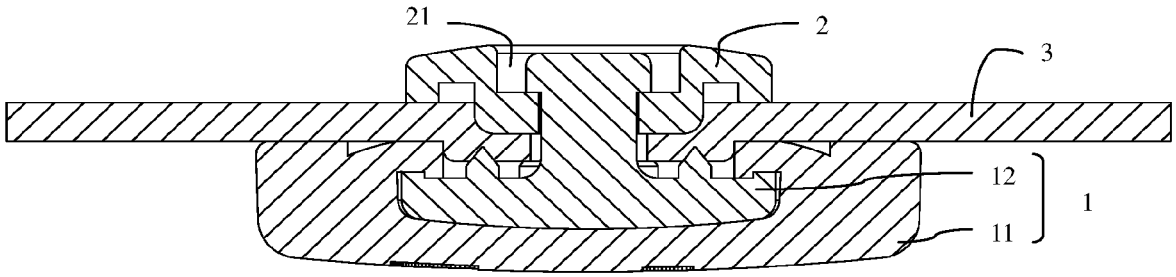
Figure 2:
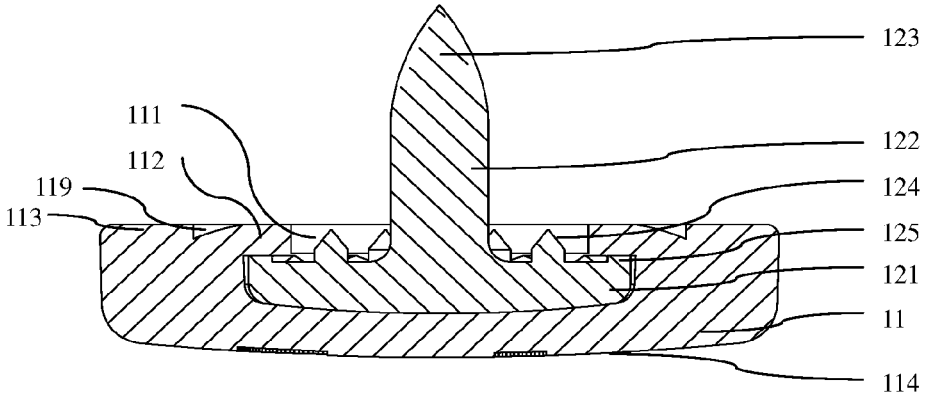
Figure 3:
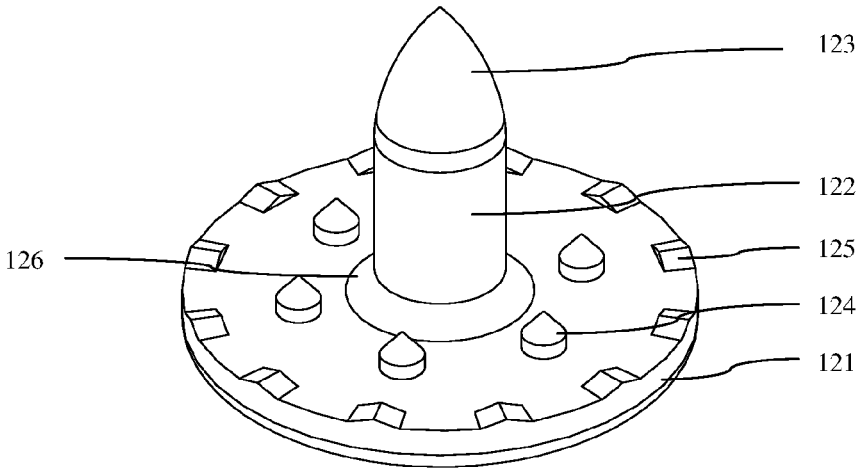
Figure 4:
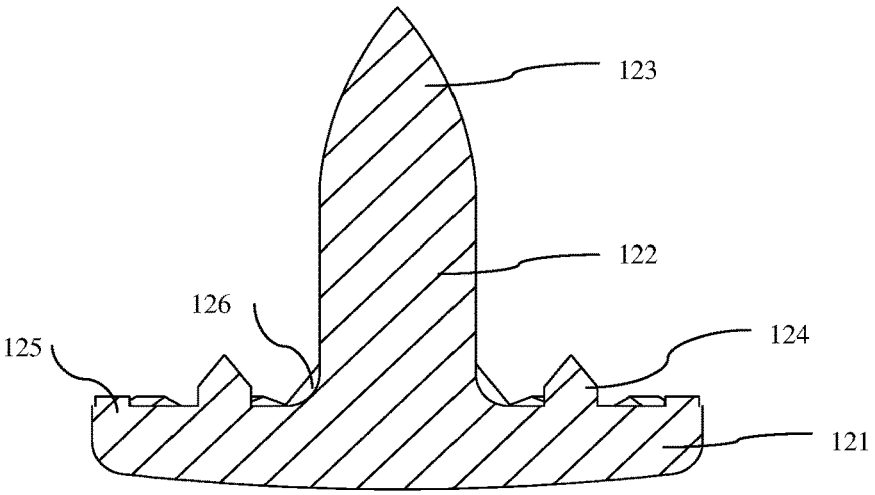
Figure 5:
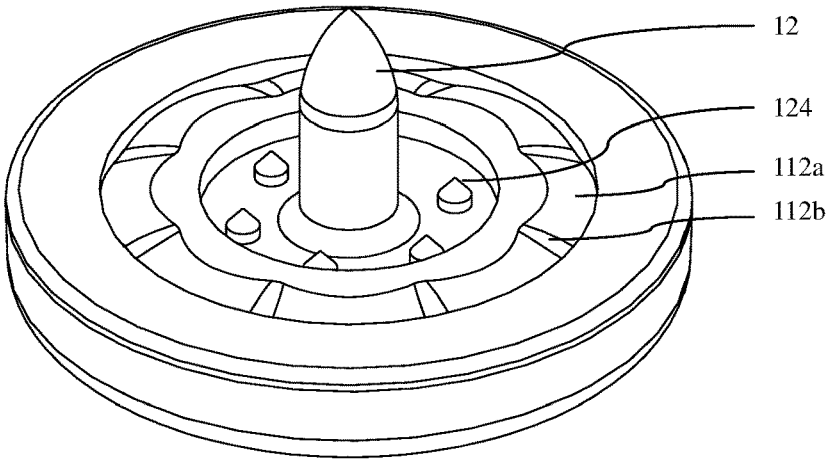
Figure 6:
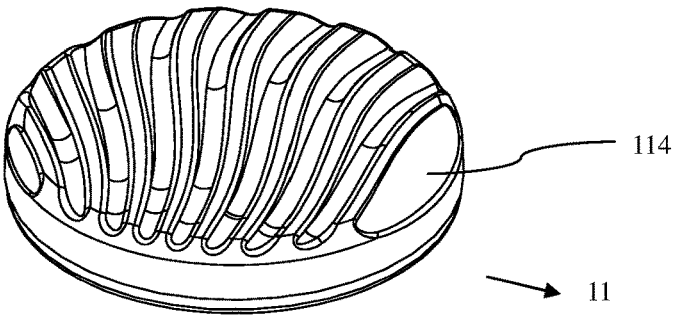
Figure 7:
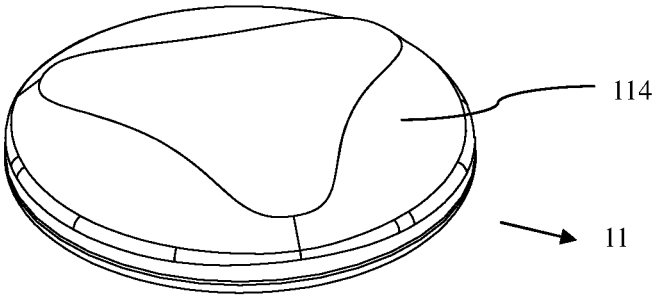
Figure 8:
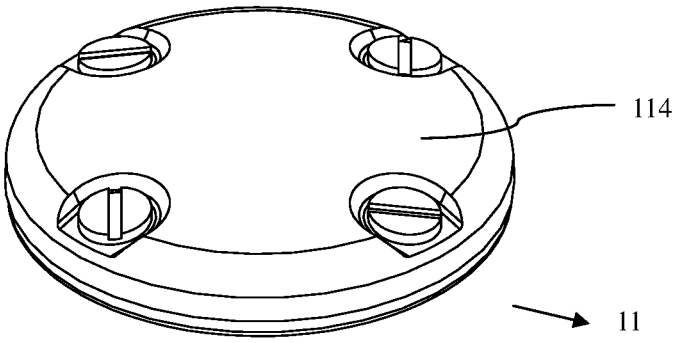
Figure 9:
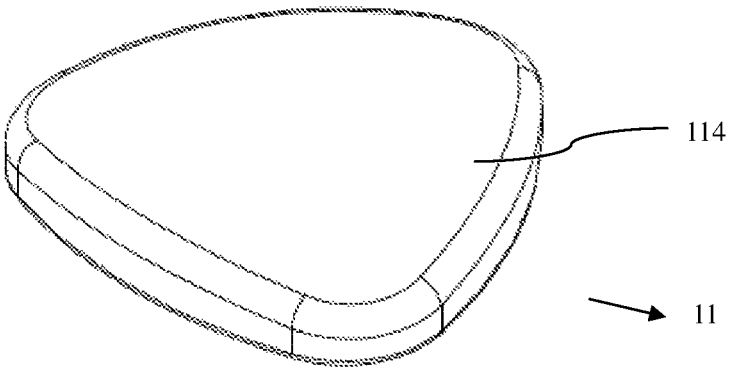
Figure 10:
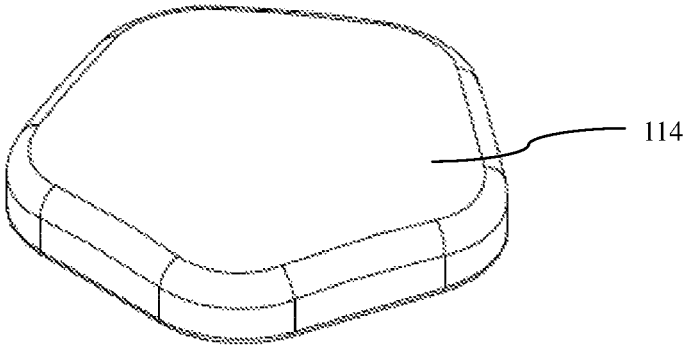
Figure 11:
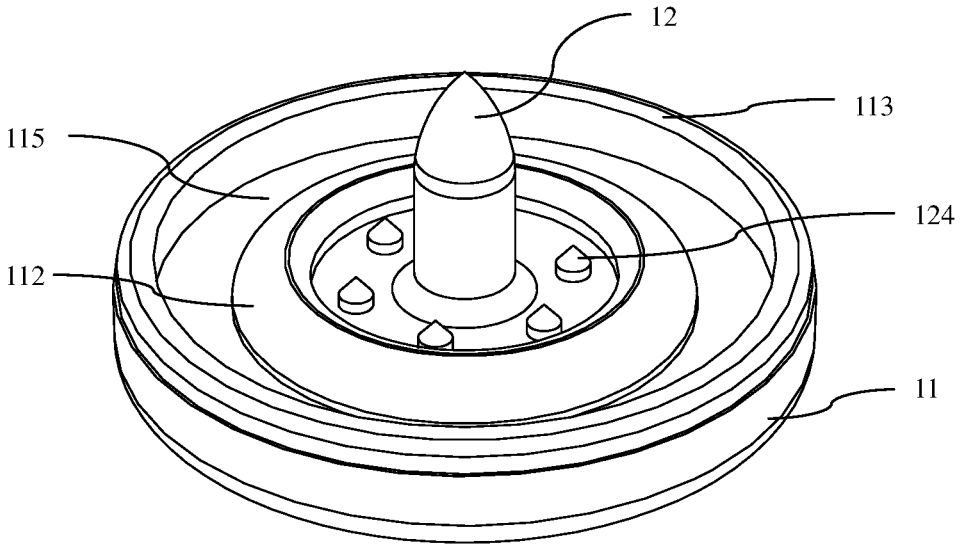
Figure 12:
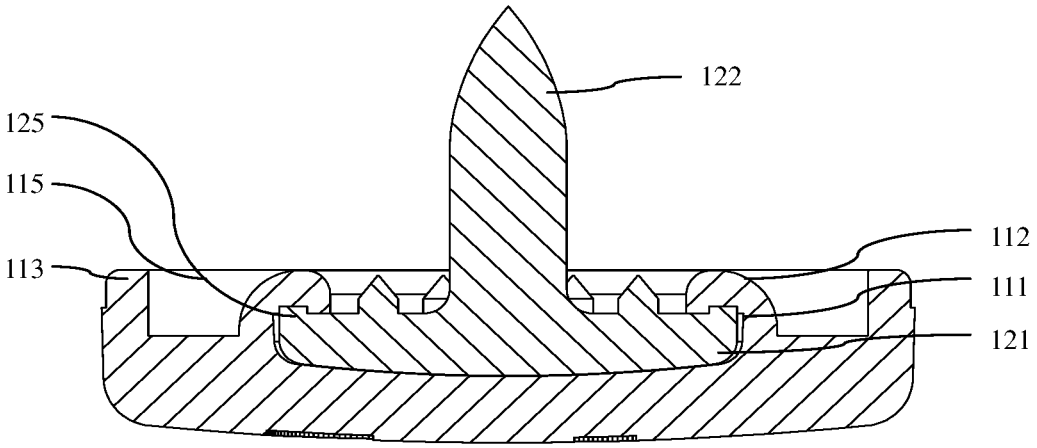
Figure 13:
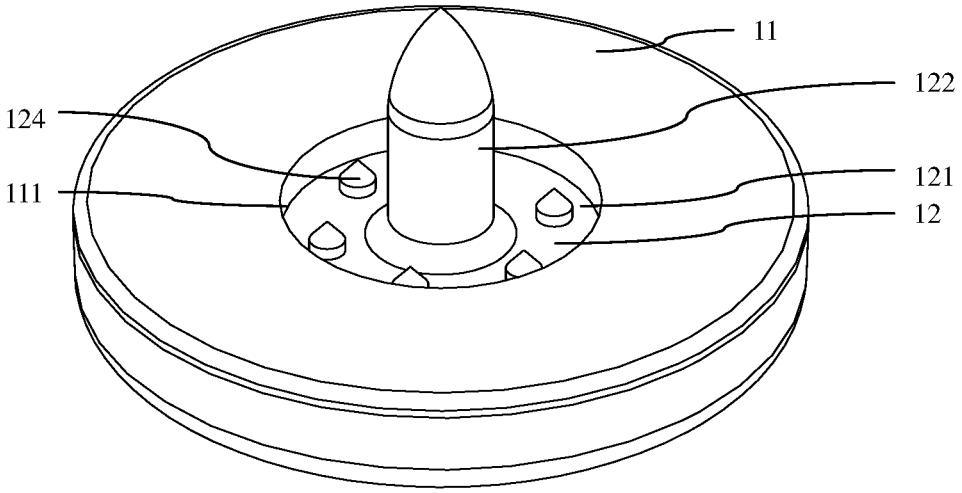
Figure 14:
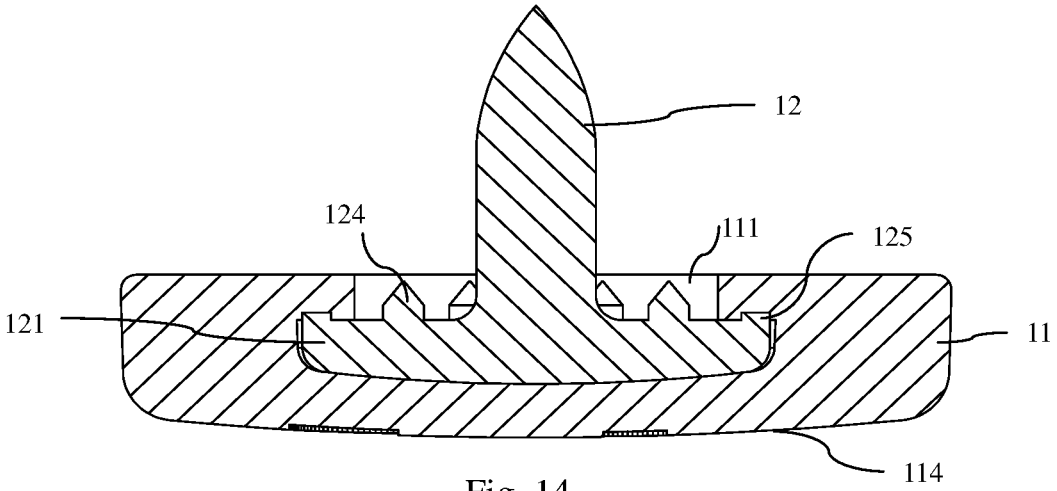
Figure 15:
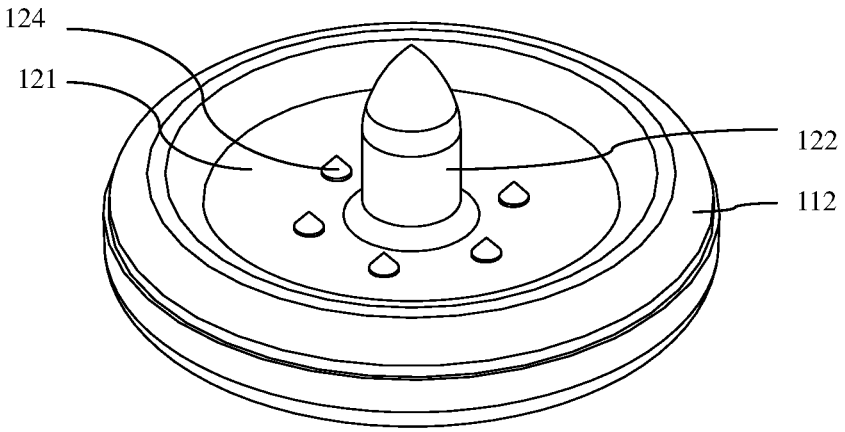
Figure 16:
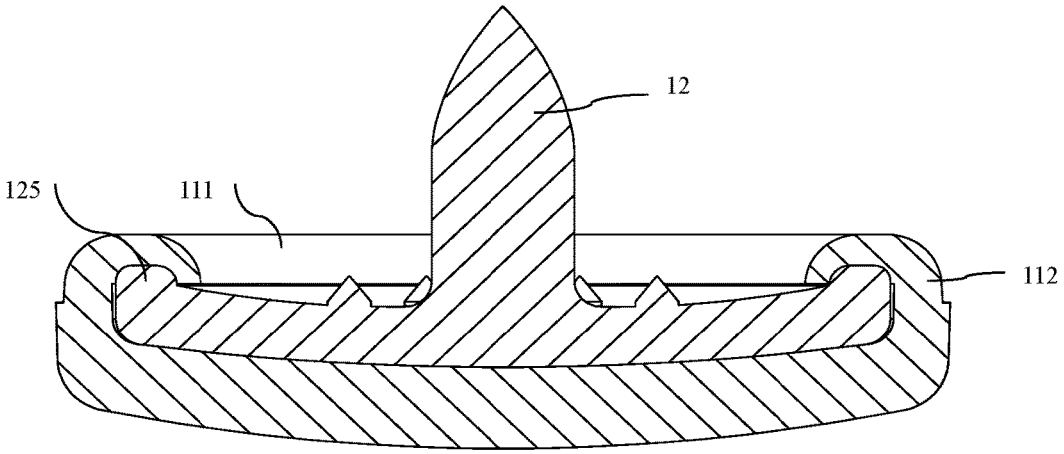
Figure 17:
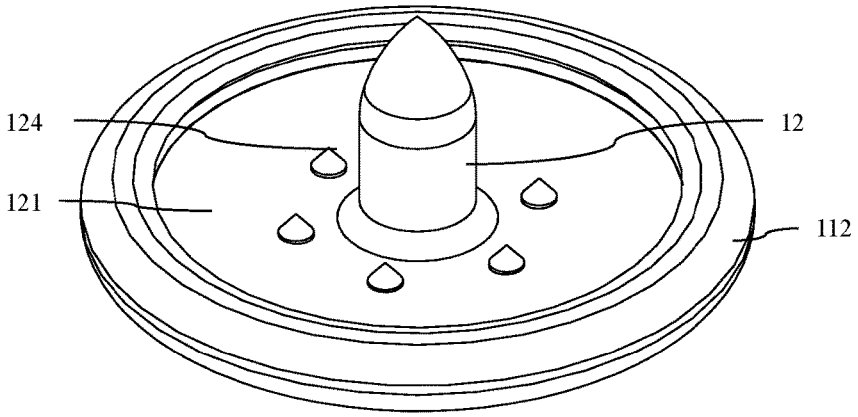
Figure 18:
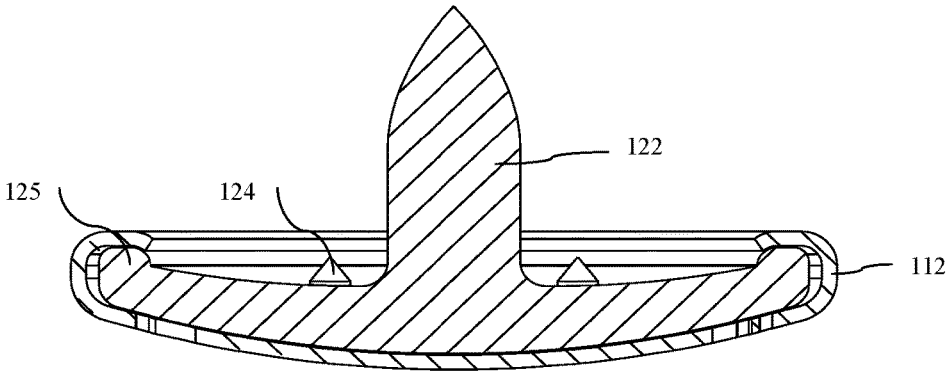
Figure 19:
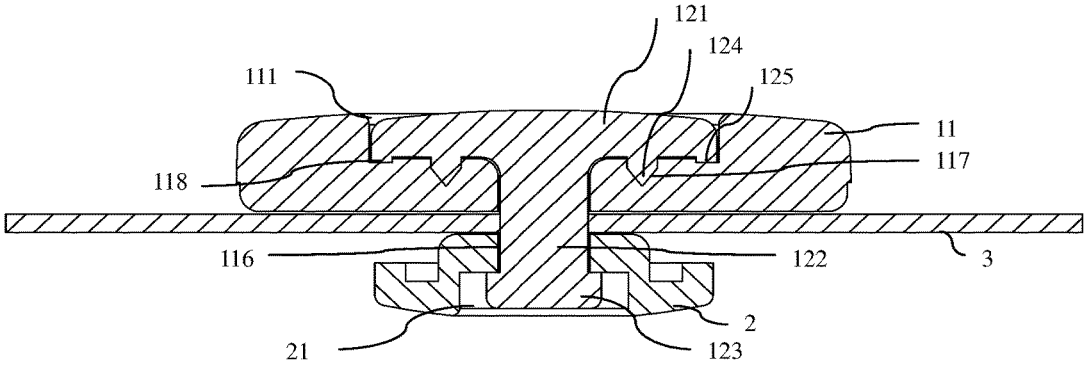

The present application will be further described with reference to the accompanying drawings and embodiments in the following, in the accompanying drawings:

FIG. 1 is a cross-section view of a snap fastener provided by a first preferred embodiment of the present application;

FIG. 2 is a cross-section view of a face fastener shown in FIG. 1;

FIG. 3 is a perspective view of a locating pin shown in FIG. 1;

FIG. 4 is a cross-section view of the locating pin shown in FIG. 1;

FIG. 5 is a perspective view of the face fastener shown in FIG. 1;

FIG. 6 is a first variant perspective view of the face fastener shown in FIG. 1;

FIG. 7 is a second variant perspective view of the face fastener shown in FIG. 1;

FIG. 8 is a third variant perspective view of the face fastener shown in FIG. 1;

FIG. 9 is a fourth variant perspective view of the face fastener shown in FIG. 1;

FIG. 10 is a fifth variant perspective view of the face fastener shown in FIG. 1;

FIG. 11 is a perspective view of the face fastener of the snap fastener provided by a second preferred embodiment of the present application;

FIG. 12 is a cross-section view of the face fastener shown in FIG. 11;

FIG. 13 is a perspective view of the face fastener of the snap fastener provided by a third preferred embodiment of the present application;

FIG. 14 is a cross-section view of the face fastener shown in FIG. 13;

FIG. 15 is a perspective view of the face fastener of the snap fastener provided by a fourth preferred embodiment of the present application;

FIG. 16 is a cross-section view of the face fastener shown in FIG. 15;

FIG. 17 is a perspective view of a variant version of the face fastener shown in FIG. 15;

FIG. 18 is a cross-section view of the face fastener shown in FIG. 17;

FIG. 19 is a cross-section view of the snap fastener provided by a fifth preferred embodiment of the present application.

THE PREFERRED EMBODIMENT OF THE PRESENT INVENTION

Detailed Description of the Preferred Embodiment

To make the technical objective, solutions and effect of the present application be understood more clearly, now the specific implementation of the present application is described in detail with reference to the accompanying drawings and embodiments. It should be understood that the specific implementations described hereof are intended to be exemplary not to be limiting.

First Embodiment: Relate to FIGS. 1-10

The FIG. 1 shows a snap fastener provided by the first preferred embodiment of the present application, and the snap fastener comprises a face fastener 1 and a locating fastener 2, which are snapped with each other. The locating fastener 2 can be a pin having a protruding rod structure as required, or can be a box having a recess structure, which is not specifically limited hereof.

In the embodiment, the face fastener 1 comprises a face shell 11 and a locating pin 12, which can be separable from each other. One end of the locating pin 12 is connected to the face shell 11, and the other end of the locating pin 12 passes through the substrate 3 and is connected to the locating fastener 2, so that the two sides of the substrate 3 are clamped by the face fastener 1 and the locating fastener 2 respectively. The substrate 3 can be made of fabric, plastic, leather, artificial leather or non-woven fabric, etc., and can usually be used for manufacturing bag bodies, shoe bodies, clothes or other products which need be fastened and opened.

As shown in FIG. 2, the face shell 11 can be made of common materials such as plastic and metal, and is disc-shaped advantageously, or can be an another shape corresponding to the locating pin 12.

An installation chamber 111 configured for accommodating the locating pin 12 is defined in an end face abutting the substrate 3 of the face shell 11, and the end face of the face shell 11 extends from a circumferential edge around an opening of the installation chamber 111 away from the end face, to form an annular fixing flange 112, which is used to cover and fix the locating pin 12 when the locating pin 12 and the face shell 11 are assembled through a variety of processing methods.

Advantageously, an annular locating block 113 is arranged on a circumferential edge of the fixing flange 112 at the outer edge of the end face of the face shell 11 in a protruding manner, and a gap is formed between the locating block 113 and the fixing flange 112; and the locating block 113 protruding from the face shell 11 is slightly lower than the fixing flange 112, which is convenient for subsequent processes.

As shown in FIGS. 3 and 4, the locating pin 12 is a standard part made of plastic and integrally formed, and comprises a base 121 accommodated in the installation chamber 111, a rod body 122 extending outward from the center of the end face of the base 121, and a connecting portion 123 forming by a reduction in diameter of an end of the rod body 122.

The base 121 is a disc-shaped structure; and one end face of the base 121 abuts against the bottom surface of the installation chamber 111, and the rod body 122 is formed on the other end face of the base 121, and anti-skidding structures 124 configured for preventing the snap fastener body from sliding relative to the substrate 3 and anti-rotation protrusions 125 configured for preventing the locating pin 12 from rotating relative to the face shell 11 are also arranged on this end face.

The rod body 122 is a columnar structure standing exactly on the base 121, and the connecting portion 123 formed by an end away from the base 121 of the rod body 122 is conical.

A cross section of the connecting portion 123 is an isosceles triangle, and an top angle of the end of the connecting portion 123 is ranged from 30° to 70°, which is convenient for the locating pin 12 to pass through the substrate 3 and be fixed by the locating fastener 2.

The anti-skidding structures 124 are protruding parts protruding from the end face of the base 121, and are located on the side of the base 121 which is same as the rod body 122. The ends of the anti-skidding structures 124 have a reduction in diameter, and can be point-like, cylindrical or can be similar to a columnar structure having a conical end formed by a reduction in diameter, to reduce the contact area between the base 121 and the substrate 3, increase pressure and improve an anti-skidding property.

The anti-rotation protrusions 125 are also protruding parts on the same side of the anti-skidding structures 124, and the anti-rotation protrusions 125 are arranged at an outer edge of the end face of the base 121 uniformly at intervals, and can be covered by the bent fixing flange 112 completely (as shown in FIG. 2); the ends away from the base 121 of the anti-rotation protrusions 125 retract.

In the embodiment, as shown in FIG. 3, cross sections of the anti-rotation protrusions 125 along a rotation direction, i.e., a tangential direction of the base 121, are triangular; and ridge portions of the anti-rotation protrusions 125 extend along a radial direction of the base 121, i.e., fixed boundaries formed on the tops of the anti-rotation protrusions 125 extend along a radial direction of the base 121. Advantageously, the cross sections are an isosceles triangle to ensure force balance.

It can be understood that the cross sections of the anti-rotation protrusions 125 can also be a deformation of triangle, for example, two side edges of the anti-rotation protrusion 125 is an arc which can be connected to the end face of the base 121 smoothly, which can meet needs of the embodiment.

As the face shell 11 is made of metal and plastic, the face shell 11 has good ductility. When the fixing flange 112 is meshed with anti-rotation protrusions 125 through processing, inner surfaces of the fixing flange 112 are respectively arranged around the anti-rotation protrusions 125 to form concavo-convex occlusion. As shown in FIG. 5, the fixing flange 112 is disc-shaped, is meshed with the anti-rotation protrusions 124, and forms lower recesses 112*a* and protruding portions 112*b*, wherein the protruding portions 112*b* fit the tops of the anti-rotation protrusions 125.

When the fixing flange 112 fits the anti-rotation protrusions 125, the protruding portions 112*b* fit the ridge portions of the tops of the anti-rotation protrusions 125; the lower recesses 112*a* are depressed along two opposite side faces of two adjacent anti-rotation protrusions 125 towards a direction of the end face of the base 121. Thus, when a tangential torque is applied between the locating pin 12 and the face shell 11, the fixing flange 112 on the face shell 11 fits the two side faces of the anti-rotation protrusions 125 along a rotation direction, the fixing flange 112 is limited by the anti-rotation protrusions 125 and can't be rotated.

Advantageously, an angle on the ridge portions of the cross sections of the anti-rotation protrusions 125 is an obtuse angle, i.e., in a possible rotation direction, the anti-rotation protrusions 125 can be connected to the base 121 smoothly. So, when processed, the occlusion between the fixing flange 112 and anti-rotation protrusions 125 can be completed easily, the gap and the looseness can not formed easily, which can avoid the fixing flange 112 from over-bending and being broken.

Advantageously, the rod body 122 is located at the center of the end face of the base 121, and the anti-skidding structures 124 are arranged between the anti-rotation protrusions 125 and the rod body 122, and are distributed around the rod body 122 uniformly. As shown in FIG. 3, the anti-skidding structures 124 are arranged on the end face of the base 121 uniformly at intervals along a circumferential direction.

When the locating pin 12 and the face shell 11 are assembled, the fixing flange 112 on the face shell 11 is bent to press and cover the anti-rotation protrusions 125; and the anti-skidding structures 124 are exposed out of the bent the fixing flange 112 to ensure be connected to the substrate 3, which can avoid the snap fastener from sliding relative to the substrate 3.

Advantageously, reinforcing ribs 126 are arranged on positions of the rod body 122 connected with the base 121 to prevent the rod body 122 from being broken from the bottom under stress. It can be understood that the reinforcing ribs 126 are not limited by protruding parts arranged around the bottom of the rod body 122 annularly in the embodiment, and can be other auxiliary structures such as supporting rib plates (not shown in Figures) arranged around the rod body 122 uniformly at intervals, which is not specifically limited hereof.

When the face fastener 1 is assembled as shown in FIGS. 2 and 5, the base 121 of the locating pin 12 is inserted down in the installation chamber 111 firstly, and abuts against the bottom of the installation chamber 111. Through cold-pressing, the fixing flange 112 is bent towards the rod body 122 to cover the anti-rotation protrusions 125 completely, to ensure the fixing flange 112 fit the anti-rotation protrusions 125 to prevent the locating pin 12 from rotating relative to the face shell 11.

In additions, as shown in FIG. 2, as the step 119 is formed because of a height difference between the fixing flange 112 and the adjacent locating block 113; and a gap exists between the fixing flange 112 and the locating block 113; and when the fixing flange 112 is bent, this step 119 structure having the gap can make the ductility of plastic or metal can achieve the optimal effect, which is convenient for the fixing flange 112 to completely cover the anti-rotation protrusions 125 to enhance an anti-rotation effect.

When the face fastener 1 and the locating fastener 2 are assembled to form the snap fastener as shown in FIG. 1, the connecting portion 123 of the locating pin 12 passes through the substrate 3, and enters into the locating opening 21 of the locating fastener 2, and then the connecting portion 123 is pressed to be socket shaped by way of riveting to be fixed in the opening of the locating opening 21, so that the face fastener 1, the substrate 3 and the locating fastener 2 are connected; and the snap fastener is fixed on the substrate 3. Now it can be seen that the top ends of the anti-skidding structures 124 can be meshed with the substrate 3 to avoid the snap fastener from sliding relative to the substrate 3.

As shown in FIGS. 6 and 7, it can be seen that the other end face of the face shell 11 away from the substrate 3 can be made into a pressing portion 114 has various colors, ornamentation and patterns according to design needs to achieve a decorating or anti-skidding effect.

As shown in FIG. 8, the face shell 11 and the base 121 of the locating pin 12 are connected directly by thread connection; the screw is exposed out of the face fastener 1 as an element of a decorating design.

As shown in FIGS. 9 and 10, the face fastener 1 of the present application can be another shape through changing the shape of the face shell 11 only; the locating pin 12 can fit the face shells 11 of different shapes. Thus, in the practical production, the locating pin 12 can be manufactured into a standard part for batch production and storage to speed up delivery.

Second Embodiment: Relate to FIGS. 11 and 12

The face shell 11 of the present embodiment is made of plastic, and the difference between the present embodiment and the first embodiment lies at: the face shell 11 and the locating pin 12 in the present embodiment are assembled to form the face fastener 1 by way of heat-pressing as shown in FIGS. 11 and 12.

When assembled, the base 121 of the locating pin 12 is inserted down in the installation chamber 111 firstly, and abuts against the bottom of the installation chamber 111; and then, through heat-pressing, the fixing flange 112 is deformed thermally, and is bent towards the rod body 122 to cover the anti-rotation protrusions 125 completely; and the inner surfaces of the fixing flange 112 are arranged around the anti-rotation protrusions 125 to form concavo-convex occlusion, so that the disc-shaped fixing flange 112 abuts against the base 121 of the locating pin 12. The fixing flange 112 fits and abuts against the anti-rotation protrusions 125 to prevent the locating pin 12 from rotating relative to the face shell 11. Moreover, the rod body 122 and the anti-skidding structures 124 are exposed outside to be connected to the substrate 3.

in order that when heat-pressed, the appearance of the face shell 11 is avoided from being affected negatively because of thermal deformation of the locating block 113 at the edge of the face shell 11, a gap between the locating block 113 and the fixing flange 112 of the present embodiment is increased to form a annular processing recess 115, so that the locating block 113 and the fixing flange 112 can be spaced at a bigger distance, which is convenient for heat pressing.

The locating pin 12 of the present embodiment is same as the first embodiment, which is not specifically limited hereof.

Third Embodiment: Relate to FIGS. 13-14

The difference between the present embodiment and the aforementioned embodiment is: the face shell 11 of the present embodiment is formed out of the locating pin 12 directly by way of injection molding.

When assembled, the manufactured locating pin 12 is arranged in an injection mold; by way of the injection molding, the face shell 11 covers the base 121 of the locating pin 12 directly; and the injection molded face shell 11 completely covers the anti-rotation protrusions 125 and is meshed therewith to prevent the locating pin 12 from moving or rotating in the face shell 11; and the anti-skidding structures 124 and the rod body 122, located at the center of the end face of the base 121 are exposed out of the installation chamber 111 to prevent the face fastener 1 from sliding relative to the substrate 3.

Because the face shell 11 is a concave-convex structure formed directly by way of injection molding and meshed with the locating pin 12, the fixing flange 112 no longer needs be used to be bent to cover the anti-rotation protrusions 125. The locating pin 12 of the present embodiment is same as the aforementioned embodiment, which is not specifically limited hereof.

Fourth Embodiment: Relate to FIGS. 15, 16, 17 and 18

The face shell 11 of the present embodiment is made of metal, and the difference between the present embodiment and the aforementioned embodiment is: the face shell 11 is a metal plate corresponding to a shape of the base 121. The face shell 11 in the present embodiment is circular, of which the edge in a circumferential direction is bent towards the center of the base 121, i.e., the rod body 122, to form the fixing flange 112 and the installation chamber 111 configured for accommodating the locating pin 12; and then, by way of pressing, the face shell 11 covers the base 121 of the locating pin 12 to form the face fastener 1.

As shown in FIGS. 16 and 18, it can be seen that the thickness of the face shell 11 is not limited, as long as the fixing flange 112 formed by the bent edge of the face shell 11 can completely cover the locating pin 12 by way of pressing.

When the face fastener 1 is assembly, the manufactured locating pin 12 is placed on the face shell 11; by way of pressing, the fixing flange 112 is bent towards the rod body 122 to completely cover the anti-rotation protrusions 125 and be meshed therewith. The inner surfaces of the fixing flange 112 are arranged around the anti-rotation protrusions to form concavo-convex occlusion. The fixing flange 112 is disc-shaped and abuts against the base 121 of the locating pin 12 to ensure the fixing flange 112 fit the anti-rotation protrusions 125, so that locating pin 12 is prevented from rotating relative to the face shell 11. Moreover, the rod body 122 and the anti-skidding structures 124 are exposed outside to be convenient to be connected to substrate 3.

The locating pin 12 of the present embodiment is same as the aforementioned embodiment, which is not specifically limited hereof.

Fifth Embodiment: Relate to FIG. 19

The difference between the present embodiment and the aforementioned embodiment is: the face shell 11 is roughly disc-shaped, and the installation chamber 111 configured for accommodating the locating pin 12 is defined in the end face away from the substrate 3 of the face shell 11. A mounting through-hole 116 passing through the face shell 11 is defined in the bottom of the installation chamber 111. In additions, locating holes 117 corresponding to the anti-skidding structures 124 are defined in the bottom of the installation chamber 111 and around the through-hole 116; and limiting recesses 118 are defined in the edge of the bottom of the installation chamber 111 in a circumferential direction.

It can be understood that limiting holes (not shown in Figures) corresponding to the anti-rotation protrusions 125 respectively can be defined in the edge of the bottom of the installation chamber 111, instead of the limiting recesses 118 distributed annularly of the present embodiment. The face shell 11 covers the anti-rotation protrusions 125 and is meshed therewith through the limiting recesses 118, to prevent the locating pin 12 from moving or rotating relative to the face shell 11 further. The limiting recesses 118 of the present embodiment simplify the limiting holes, which is convenient for processing.

The locating pin 12 of the present embodiment is same as the aforementioned embodiment, which is not specifically limited hereof.

When the face fastener 1 is assembled, the rod body 122 of the locating pin 12 is inserted down in the mounting through-hole 116 firstly, the base 121 is inserted in the installation chamber 111, the anti-skidding structures 124 are fixed in the corresponding the locating holes 117, and the anti-rotation protrusions 125 are also located in the limiting recesses 118. If the limiting recesses 118 are designed to be limiting holes corresponding to the anti-rotation protrusions 125 respectively, the face shell 11 completely covers the anti-rotation protrusions 125 and is meshed therewith.

When the snap fastener is mounted, the rod body 122 extending from the face shell 11 passes through the substrate 3 and the locating fastener 2 successively, and the connecting portion 123 is pressed to be socket shaped by riveting to be fixed in the locating opening 21, so that the face fastener 1, the substrate 3 and the locating fastener 2 are connected to fix the snap fastener on the substrate 3.

In the embodiment, the anti-skidding structures 124 is fixed in the locating holes 117 in the bottom of the installation chamber 111, and does not contact the substrate 3, which is used to prevent the locating pin 12 from moving or rotating relative to the face shell 11. Advantageously, anti-skidding protruding parts (not shown in Figures) can be formed on the end face away from the installation chamber 111 of the face shell 11, which is configured for being meshed with the substrate 3, to prevent the snap fastener from sliding relative to the substrate 3.

When implementing the snap fastener of the present application, the following advantageous effects can be achieved:

(1) The face fastener 1 of the present application can be separated into the face shell 11 and the locating pin 12, which are snapped with each other, so that the locating pin 12 can be manufactured into a standard part for batch production and storage, thereby speeding up delivery and avoiding delay because of a large workload.

(2) As the face fastener 1 of the present application can be separated into the face shell 11 and the locating pin 12, the design of face shell 11 can be variegated as required and be not limited by the material and the color of the locating pin 12.

(3) The locating pin 12 of the present application is made of plastic material, has portability and lower costs; moreover, need not adopt an electroplating step required by metal material, which is more beneficial to the recycling of resources and environmental protection.

(4) The design of the anti-rotation protrusions 125 can prevent the locating pin 12 from rotating relative to the face shell 11 effectively; moreover, the cross sections of the anti-rotation protrusions 125 of the present application along a rotation direction, are designed to be an isosceles triangle, which can improve force balance of anti-rotation protrusions and enhance its strength to ensure it not easy to be broken.

(5) The ridge portions of the anti-rotation protrusions 125 extend along a radial direction of the base, and a top angle of the anti-rotation protrusion 125 is an obtuse angle, so that two side portions of the anti-rotation protrusion 125 can be connected to the end face of the base smoothly; and when processed and assembled, the reliable occlusion between the fixing flange 112 and anti-rotation protrusions 125 can be completed easily, the gap and the looseness are not formed easily, which can avoid the fixing flange 112 from over-bending and being broken.

(6) The anti-skidding structures 124 is protruding parts exposed out of the face shell 11, and the end of the protruding part has a reduction in diameter, which can reduce the contact area between the base 121 and the substrate 3 and increase pressure to make the anti-skidding structures be embedded into the substrate 3, to avoid the snap fastener from sliding relative to the substrate 3 effectively.

(7) Reinforcing ribs 126 are arranged on positions of the rod body 122 connected with the base 121 to prevent the rod body 122 from being broken from the bottom under stress.

(8) The anti-rotation protrusions 125 are arranged on the edge of the base 121 along a circumferential direction, which can increase the thickness and strength of the base 121 to avoid phenomena such as cracks and breaks, when the base 121 and the face shell 11 are assembled through a variety of processing methods.

(9) The connecting portion 123 formed by an end of the rod body 122 is conical. A cross section of the connecting portion 123 is an isosceles triangle, and a top angle of the connecting portion 123 is ranged from 30° to 70°, which is convenient for the locating pin 12 to pass through the substrate 3 and be fixed by the locating fastener 2.

(10) The step 119 is formed because of a height difference between the fixing flange 112 and the adjacent locating block 113; and a gap exists between the fixing flange 112 and the locating block 113; and when the fixing flange 112 is bent, this step 119 structure having the gap can make the ductility of plastic or metal achieve the optimal effect, which is convenient for the fixing flange 112 to completely cover the anti-rotation protrusions 125 and fit the anti-rotation protrusions 125 to enhance an anti-rotation effect.

While the embodiments of the present application are described, the skilled person should understand that not beyond the scope of the present application, the present application can have all kinds of transformations and equivalent replacements. In additions, aiming at a specific situation or material, those ordinary skills in the art can also make many modifications without breaking away from the scope of the present application. Therefore, the present application is not limited to the above-mentioned specific implementations, and should include all these modifications belonging to the scope of claims of the present application.

The invention claimed is:

1. A snap fastener comprising a face fastener (1) and a locating fastener (2) which are snapped with each other, wherein, the face fastener (1) comprises: a face shell (11), wherein the face shell (11) is provided with an installation chamber (111); and a locating pin (12); and the locating pin (12) is made of plastic and integrally formed, and includes: a base (121), wherein the base (121) is accommodated in the installation chamber (111); and anti-skidding structures (124) are arranged on an end face exposed out of the installation chamber (111) of the base (121); a rod body (122), wherein the rod body (122) stands exactly on an end face of the base (121), and an end away from the base (121) of the rod body (122) is used to be connected to the locating fastener (2); and anti-rotation protrusions (125), wherein the anti-rotation protrusions (125) are arranged at an outer edge of the end face in connection with the rod body (122) of the base (121) in a protruding manner, and ends away from the base (121) of the anti-rotation protrusions (125) shrink; and when the base (121) is accommodated in the installation chamber (111), so that the locating pin (12) and the face shell (11) are assembled; a fixing flange (112) is formed at an edge of an opening around the installation chamber (111) in an end face of the face shell (11), so that when the locating pin (12) and the face shell (11) are assembled, the face shell (11) completely covers the anti-rotation protrusions (125) and is meshed therewith; when the locating pin (12) and the face shell (11) are assembled, the fixing flange (112) is bent by way of riveting, heat-pressing or cold-pressing to completely cover the anti-rotation protrusions (125) and be meshed therewith; and inner surfaces of the fixing flange (112) are respectively arranged around the anti-rotation protrusions (125) to form concavo-convex occlusion.

2. The snap fastener according to claim 1, wherein, a locating block (113) is arranged around an edge of the fixing flange (112) at the outer edge of the end face of the face shell (11) in a protruding manner, and the locating block (113) is slightly lower than the fixing flange (112) and is spaced therewith.

3. The snap fastener according to claim 1, wherein, the face shell (11) is a metal plate structure matching with a shape of the base (121); and an edge of the face shell (11) is bent towards the rod body (122) to form the fixing flange (112) and the installation chamber (111).

4. The snap fastener according to claim 1, wherein, cross sections of the anti-rotation protrusions (125) along a tangential direction of the base (121) are triangular, and ridge portions of the anti-rotation protrusions (125) extend along a radial direction of the base (121).

5. The snap fastener according to claim 1, wherein, the rod body (122) is located at the center of the end face of the base (121), and the anti-rotation protrusions (125) are distributed on the outer edge of the end face of the base (121) uniformly along a circumferential direction; the anti-skidding structures (124) are arranged between the anti-rotation protrusions (125) and the rod body (122) uniformly along a circumferential direction; and the anti-skidding structures (124) and the rod body (122) are exposed out of the face shell (11).

6. The snap fastener according to claim 1, wherein, reinforcing ribs (126) are arranged on positions of the rod body (122) connected with the base (121).

* * * * *